US010281114B2

(12) United States Patent
Nishida et al.

(10) Patent No.: US 10,281,114 B2
(45) **Date of Patent: *May 7, 2019**

(54) LIGHT CONTROL DEVICE

(71) Applicant: DAI NIPPON PRINTING CO., LTD., Tokyo (JP)

(72) Inventors: Tomonori Nishida, Tokyo (JP); Norihisa Moriya, Tokyo (JP); Yukio Taniguchi, Tokyo (JP); Satoshi Mitsuzuka, Tokyo (JP); Masayuki Sekido, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/891,825

(22) PCT Filed: May 20, 2014

(86) PCT No.: PCT/JP2014/063390

§ 371 (c)(1),
(2) Date: Feb. 22, 2016

(87) PCT Pub. No.: WO2014/189061

PCT Pub. Date: Nov. 27, 2014

(65) Prior Publication Data

US 2016/0178164 A1 Jun. 23, 2016

(30) Foreign Application Priority Data

May 22, 2013 (JP) ..... 2013-108279

(51) Int. Cl.
*F21V 11/04* (2006.01)
*F21S 11/00* (2006.01)
(Continued)

(52) U.S. Cl.
CPC ..... *F21V 11/04* (2013.01); *E06B 9/24* (2013.01); *E06B 9/264* (2013.01); *E06B 9/28* (2013.01);
(Continued)

(58) Field of Classification Search
CPC ..... F21S 11/007; F21V 11/04; E06B 9/24
(Continued)

(56) References Cited

U.S. PATENT DOCUMENTS 2,979,127 A * 4/1961 Brown ..... E06B 9/306 160/115
7,352,509 B2 * 4/2008 Pagel ..... E04D 13/033 136/251
(Continued)

FOREIGN PATENT DOCUMENTS

JP S6-139387 A 10/1981
JP 57-153188 U 9/1982
(Continued)

OTHER PUBLICATIONS

International Search Report (Application No. PCT/JP2014/063390) dated Aug. 26, 2014.
Japanese Office Action (With English Translation), Japanese Application No. 2015-197968, dated Jan. 17, 2017 (9 pages).

*Primary Examiner* — Christopher E Mahoney
(74) *Attorney, Agent, or Firm* — Burr & Brown, PLLC

(57) ABSTRACT

A light control device includes: a sheet-like light control member; and a support device supporting the light control member such that an orientation of the light control member is variable. The light control member includes: first portions arranged in a first direction along a sheet plane of the light control member, each first portion extending in a second direction that is in non-parallel with the first direction and along the sheet plane of the light control member; and second portions arranged in the first direction alternately
(Continued)

with the first portions, each second portion extending in the second direction.

14 Claims, 7 Drawing Sheets

(51) Int. Cl.

| | |
|---|---|
| ***E06B 9/303*** | (2006.01) |
| ***E06B 9/24*** | (2006.01) |
| ***F21V 9/00*** | (2018.01) |
| ***E06B 9/264*** | (2006.01) |
| ***E06B 9/28*** | (2006.01) |

(52) U.S. Cl.
CPC ..... *E06B 9/303* (2013.01); *F21S 11/007* (2013.01); *F21V 9/00* (2013.01); *E06B 2009/2417* (2013.01); *E06B 2009/2441* (2013.01); *E06B 2009/2643* (2013.01)

(58) Field of Classification Search
USPC ..... 359/596, 598
See application file for complete search history.

(56) References Cited

U.S. PATENT DOCUMENTS

| | | | | |
|---|---|---|---|---|
| 8,000,014 | B2 * | 8/2011 | Whitehead | F24J 2/16 359/592 |
| 9,429,288 | B2 * | 8/2016 | Ueki | E06B 9/386 |
| 2010/0092784 | A1 * | 4/2010 | Kamada | B32B 17/10 428/426 |
| 2012/0327507 | A1 * | 12/2012 | Padiyath | G02B 5/045 359/359 |
| 2015/0049387 | A1 * | 2/2015 | Kashiwagi | B29C 43/021 359/592 |
| 2015/0285454 | A1 * | 10/2015 | Aizenberg | E06B 9/24 359/226.3 |
| 2016/0273724 | A1 * | 9/2016 | Sakuragi | E06B 3/66 |

FOREIGN PATENT DOCUMENTS

| | | | | |
|---|---|---|---|---|
| JP | H04-62785 | U | 5/1992 | |
| JP | H07-38590 | U | 7/1995 | |
| JP | 2006-222011 | A1 | 8/2006 | |
| JP | 2009-186879 | A | 8/2009 | |
| JP | 2009-266794 | A1 | 11/2009 | |
| JP | 2010-259406 | A1 | 11/2010 | |
| JP | 2012-255951 | A1 | 12/2012 | |
| KR | 101205520 | B1 * | 11/2012 | E06B 9/322 |

* cited by examiner

LIGHT CONTROL DEVICE

BACKGROUND OF THE INVENTION

1. Field of The Invention

The present disclosure relates to a light control device including a light control member including first portions and second portions are alternately arranged.

2. Description of Related Art

As disclosed in JP2006-222011A, there is known a light control device or a daylighting device including a light control member to be disposed on a window member, the light control member including first portions and second portions that are alternately arranged. The light control member of such a light control device exerts a predetermined optical function on sunlight, due to reflection and refraction of an interface between the first portion and the second portion, or owing to a functional substance contained in the first portion or the second portion.

For example, when the second portion contains a visible-light absorbing material, as in the light control member disclosed in JP2006-222011A, the light control member transmits light coming from a normal direction thereof, while the light control member shields visible light coming from a direction that is inclined upward to some extent relative to the normal direction. Namely, the light control member can exert a light shielding function from a viewpoint of anti-glare effect, by restraining direct sunlight from entering a room. Alternatively, when the second portion contains a heat-ray absorbing material, the light control member can exert a heat shielding function by shielding heat rays included in the sunlight coming from the direction that is inclined upward to some extent relative to the normal direction. Further, when the first portion and the second portion have different refractive indexes, the light control member can exert a daylighting function (letting-in-light function, improving-lighting function) for letting in the sunlight in a desired direction in the room, by reflecting sunlight coming from a predetermined direction to change a traveling direction thereof.

However, relative positions of the light control member and the sun vary depending firstly on a longitude and a latitude of a place where the light control member is installed, and/or an orientation at which the light control member is installed. Thus, normally, the arrangement, shapes, materials, etc. of the first portion and the second portion should be suitably set for each of the light control members that are installed in different places. Moreover, the relative positions of the light control member and the sun vary depending on seasons and hours. Thus, even when the light control member is designed in consideration of installation conditions, it is not sufficient. The light control member cannot sufficiently exert a function that is expected to be offered by the light control member, continuously through a whole year or even through a certain day.

If the light control member can exert the expected functions, such as the daylighting function, the light shielding function, the heat shielding function, etc., regardless of seasons and hours, the use of an illumination tool, an air conditioner or the like can be restrained whereby energy can be saved and $CO_2$ can be reduced. However, in order that the light control member can sufficiently exert predetermined functions on sunlight regardless of seasons and hours, it is necessary to prepare light control members having different structures from one another, and to select and use a suitable light control member to be used depending on seasons and hours.

SUMMARY OF THE INVENTION

The present invention has been made in view of the above circumstances. The object of the present invention is to provide a light control device capable of effectively prevent the lowering of an optical function depending on installation places, seasons and hours.

A light control device according to some embodiments comprises:

a sheet-like light control member; and a support device supporting the light control member such that an orientation of the light control member is variable;

wherein:

the light control member includes:

first portions arranged in a first direction along a sheet plane of the light control member, each first portion extending in a second direction that is in non-parallel with the first direction and along the sheet plane of the light control member; and second portions arranged in the first direction alternately with the first portions, each second portion extending in the second direction.

According to some embodiments, the support device supports the light control member such that the orientation of the light control member is variable. Thus, by adjusting the orientation of the light control member depending on installation places, seasons, hours and so on, lowering of the function of the light control member related to an installation place, a season and an hour can be effectively prevented.

DETAILED DESCRIPTION OF THE INVENTION

Figure 1:
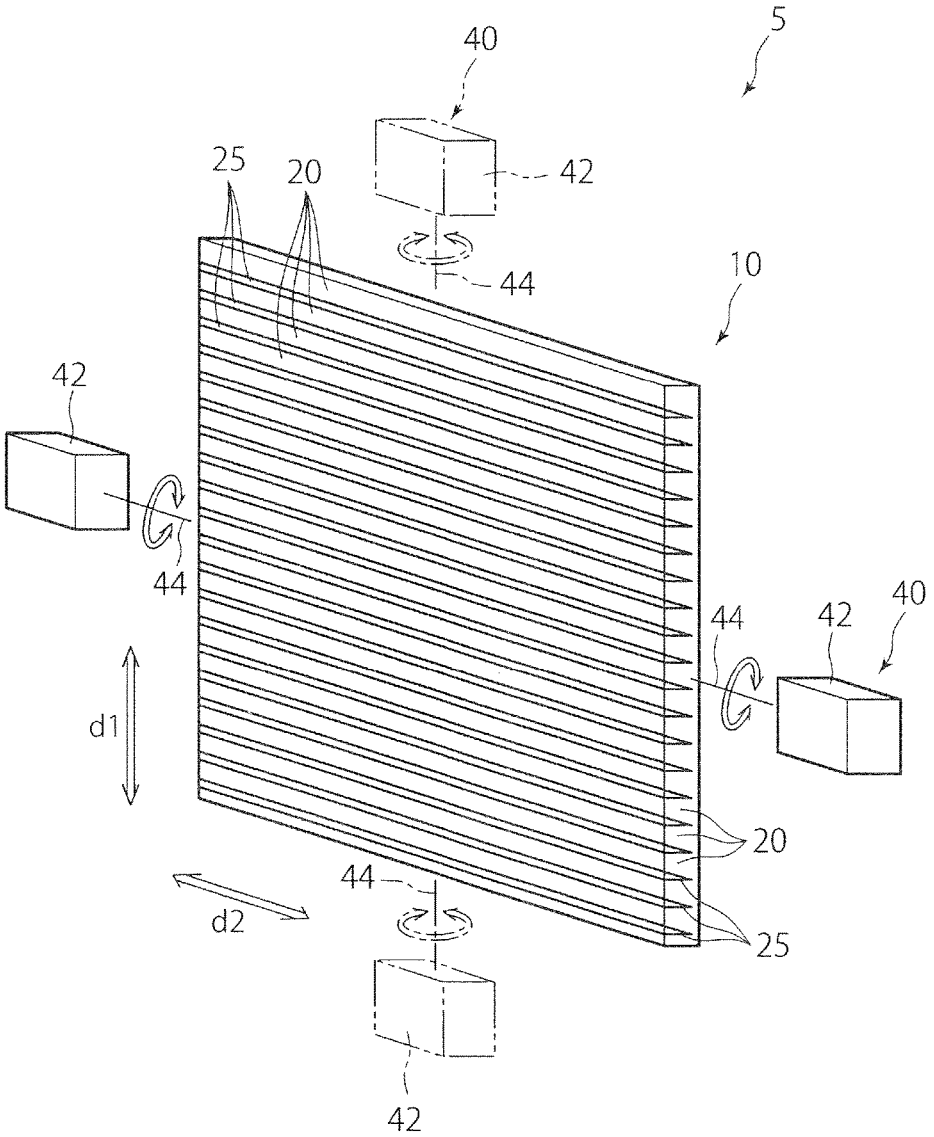
FIG. 1 is a perspective view schematically showing a light control device including a light control member and a support device, for explaining an embodiment of the present invention.

Embodiments of the present invention will be described herebelow with reference to the drawings. In the drawings attached to the specification, a scale size, an aspect ratio and so on are changed and exaggerated from the actual ones, for the convenience of easiness in illustration and understanding.

In this specification, the terms "sheet", "film" and "plate" are not differentiated from one another, based only on the difference of terms. For example, the "sheet" is a concept including a member that can be referred to as film or plate.

Further, terms specifying shapes, geometric conditions and their degrees, e.g., "parallel", "perpendicular", "same", etc., are not limited to their strict definitions, but construed to include a range capable of exerting a similar function.

Furthermore, the term "sheet plane (film plane, plate plane)" means a plane corresponding to a plane of a sheet-like (film-like plate-like) member as a target, when the sheet-like (film-like, plate-like) member as a target is seen as a whole in general.

Figure 2:
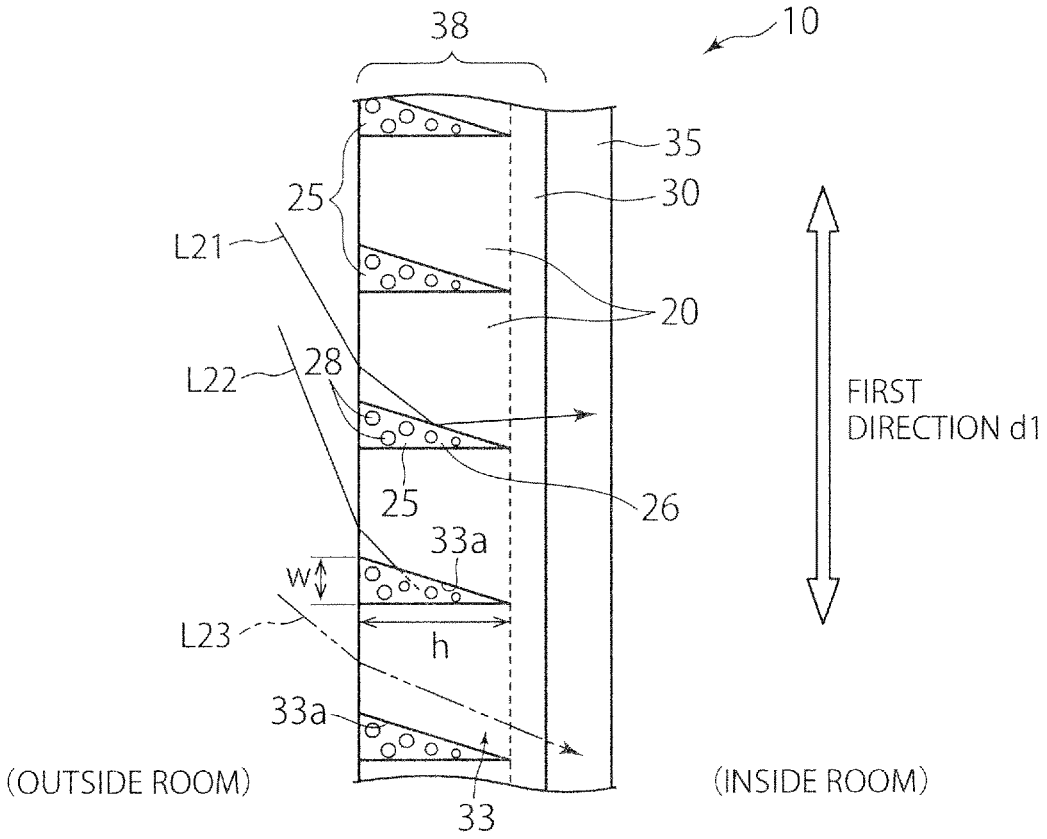
FIG. 2 is a longitudinal sectional view of the light control member, for explaining operations of the light control device and the light control member shown in FIG. 1.
Figure 3:
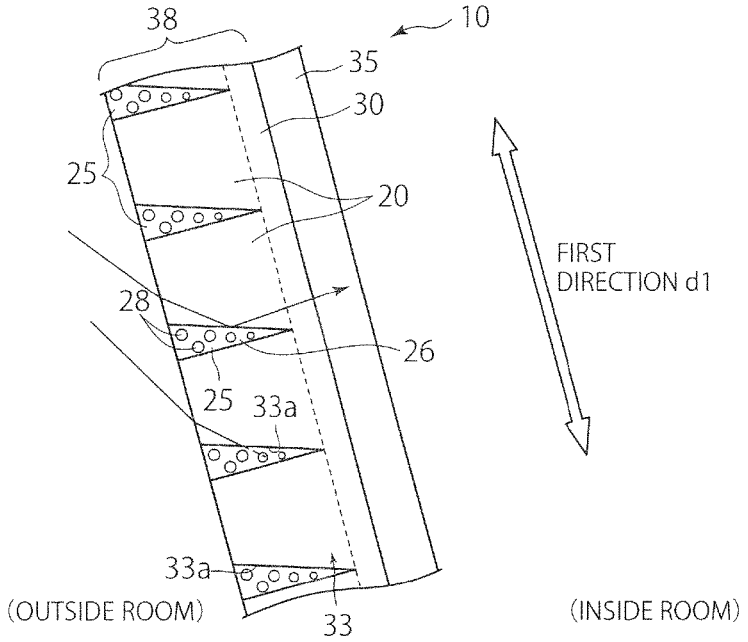
FIG. 3 is a longitudinal sectional view of the light control member supported in an orientation different from that of FIG. 2, for explaining operations of the light control device and the light control member shown in FIG. 1.
Figure 4:
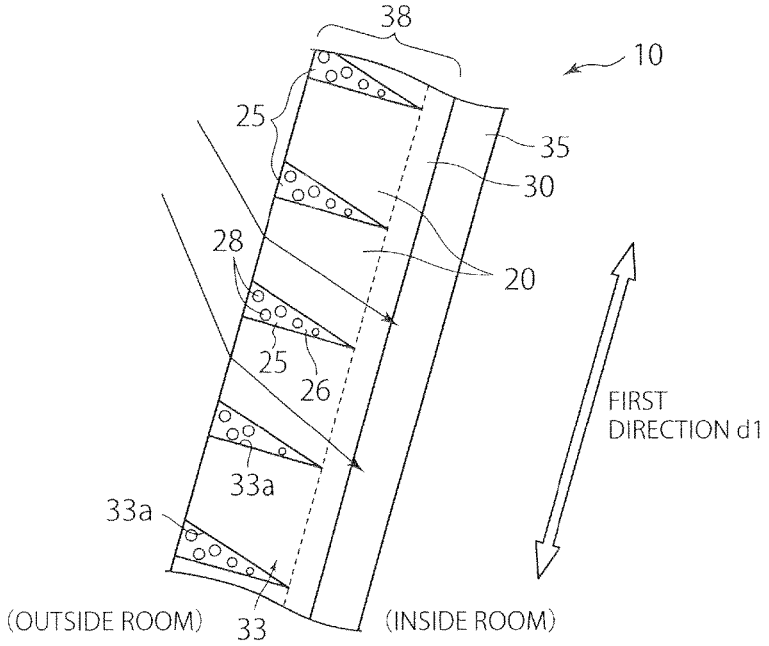
FIG. 4 is a longitudinal sectional view of the light control member supported in an orientation different from those of FIGS. 2 and 3, for explaining operations of the light control device and the light control member shown in FIG. 1.

FIGS. 1 to 4 are views for explaining some embodiments of the present invention. FIG. 1 is a view showing the light control device and a sheet-like light control member. FIGS. 2 to 4 are longitudinal sectional views of the light control member, for explaining functions of the light control device and the light control member.

A light control device 5 described below is composed of a light control member 10 formed like a sheet having a planar extension, and a support device (supporter, support means) 40 supporting the light control member 10. Namely, the light control member 10 in this embodiment is formed as a member that can be referred to as a light control sheet, a light control film or a light control plate. The light control member 10 is supported by the support device 40 on a daylighting opening of a building or a position facing a window member such as a transparent pane fitted in the opening, for example. The light control member 10 performs various optical actions on light, in particular, sunlight which will be incident on a room. In the light control device 5 described herein, the support device 40 supports the light control member 10 such that an orientation of the light control member 10 can be varied (variable), in other words, a normal direction nd to a sheet plane of the light control member 10 can be varied. As a result, as described below, the light control member 10 can more effectively exert its function.

The light control member 10 may be attached to a window member formed of a pane or the like, or may be structured as a part of the window member formed of the pane or the like, or may be sandwiched and supported between a pair of window members 50. Further, the plural light control members 10 may be disposed on one opening. Furthermore, the light control members 10 may be supported by the same support device 40, or the support devices 40 that are different from each other.

As shown in FIG. 1, as a concrete structure, the light control member 10 includes first portions 20 that are arranged in a first direction d1 along a sheet plane of the light control member 10, and second portions 25 that are arranged along the first direction d1 alternately with the first portions 20. The first portions 20 and the second portions 25 linearly extend in a second direction d2 which is in parallel with the sheet plane of the light control member 10 and is not in parallel with the first direction d1. In the illustrated example, the first portions 20 and the second portions 25 are adjacent to each other and alternately arranged in the first direction d1. The first direction d1 is perpendicular to the second direction d2. The first portions 20 and the second portions 25 respectively extend linearly.

As shown in FIGS. 2 to 4, the light control member 10 in this embodiment has a light control layer 38 including the first portions 20 and the second portions 25, and a substrate layer 35 laminated on the light control layer 38. In this embodiment, although the substrate layer 35 is provided because of a below-described manufacturing method of the light control layer 38, the substrate layer 35 is not an indispensably constituent element. Thus, the substrate layer 35 may be formed of a mere transparent or semitransparent resin film, for example.

On the other hand, in addition to the first portions 20 and the second portions 25, the light control layer 38 may further include a sheet-like base portion (land part) 30 that supports the first portions 20 and the second portions 25. The base portion 30 is integrally formed with the first portions 31 so as to form a body part 33 together with the first portions 20. In other words, the light control layer 38 of the light control member 10 includes the body part 33 having grooves 33*a* formed therein, and the second portions 25 respectively formed in the grooves 33*a* of the body part 33. A portion between the adjacent grooves 33*a* of the body part 33 defines the first portion 20.

FIGS. 2 to 4 show a main section of the light control member 10, i.e., the section being in parallel both with the first direction d1 along which the first portions 20 and the second portions 25 are arranged (arrangement direction), and with the normal direction nd to the sheet plane of the light control member 10. As shown in FIGS. 2 to 4, the second portion 25 includes: a bottom surface 25*a* partially forming a surface of the light control member 10, the surface being opposed to the light control layer 35; a first side surface 25*b* extending from the bottom surface 25*a*; and a second side surface 25*c* extending from the bottom surface 25*a*. In the illustrated example, the first side surface 25*b* and the second side surface 25*c* are apart from each other along the first direction d1. The first side surface 25*b* and the second side surface 25*c* gradually come close to each other along the normal direction to the sheet plane of the light control member 10, as they go away from the bottom surface 25*a*, and finally connect to each other. The first side surface 25*b* and the second side surface 25*c* are formed as flat surfaces. As a result, in the illustrated example, the second portion 25 has a triangular shape in a section perpendicular to its longitudinal direction, while the first portion 20 has a trapezoidal shape in a section perpendicular to its longitudinal direction.

In the illustrated example, the second portions 25 are arranged at equal intervals therebetween along the first direction d1. In addition, each second portion 25 extends in the second direction d2 without changing its sectional shape. Further, the second portions 25 included in the light control member 10 have the same structure with each other. In accordance with the structure of the second portion 25, in the illustrated example, the first portions 20 included in the light control member 10 are arranged at equal intervals therebetween along the first direction d1. Each first portion 20 extends in the second direction without changing this sectional shape. In addition, the first portions 20 have the same structure with each other.

In the section shown in FIG. 2, an arrangement pitch of the second portions 25 along the second direction d1 may be 1 mm or less, for example, and a height h of the second portion 25 along the normal direction to the sheet plane of the light control member 10 may be 1 mm or less. A thickness of the light control member 10 along the normal direction to the sheet plane of the light control member 10 may be not less than 300 μm and not more than 2 mm.

A ratio of the height h of the second portion 25 along the normal direction to the sheet plane of the light control member 10 relative to the width w of the second portion 25 along the sheet plane of the light control member 10, that is to say, an aspect ratio represented as h/w is preferably greater than 1, and more preferably 5 or more, in order to sufficiently exert functions described later, in combination with the light control member 10 supported such that its orientation can be varied. In addition, the aspect ratio is preferably 10 or less, in consideration stability in manufacture.

Note that the aforementioned structures of the first portions 20 and the second portions 25 are mere examples, and their structures can be suitably modified in consideration of, e.g., a below-described function of the light control member 10. For example, the first side surface 25*b* of the second portion 25 may be formed as a bent surface or a curved surface. In addition, the sectional shape of the second portion 25 may be changed into various shapes such as a trapezoidal shape. Moreover, the first portions 20 included in the light control member 10 may differ in shape and/or arrangement. Similarly, the second portions 25 included in the light control member 10 may differ in shape and/or arrangement.

Next, materials of the first portion 20 and the second portion 25 are explained. The materials of the first portion 20 and the second portion 25 are selected such that the light control member 10 can exert a certain function on light incident thereon, due to reflection and refraction of an interface between the first portion 20 and the second portion 25, or owing to a functional substance 28 contained at least in one of the first portion 20 and the second portion 25. Herebelow, an example in which the first portion 20 is transparent or semitransparent is described.

The first portion 20 may be formed by using a material having preferably a visible light transmittance of 50% or more, or more preferably a visible light transmittance of 70% or more, so as to be transparent or semitransparent. In this embodiment, the base portion 30 is integrally formed with the first portions 20 using the same material as that of the first portions 20. As a material for use in the body part 33 forming the first portions 20 and the base portion 30, there may be used a resin material, in particular, a cured material of an ionizing radiation curing resin which cures by irradiation of an ionizing radiation, for example. As the ionizing radiation curing resin, an ultraviolet curing resin, an electron radiation curing resin, a visible light curing resin, a near-infrared radiation curing resin may be taken for instance.

The visible light transmittance in this specification is determined as follows. A 1-μm thick film of a material forming a part to be measured is deposited on a PET film manufactured by TOYOBO Co., Ltd. (product number: Cosmo Shine A4300, thickness: 100 μm). Then, by using a spectrophotometer (manufactured by Shimadzu Corporation, "UV-2450", compliant with JISK0115), transmittances of the part are measured with measurement wavelength range of from 380 nm to 780 nm. An average value of the transmittances at the respective wavelengths is the visible light transmittance. Similarly, a heat ray transmittance described later is determined as follows. A 1-μm thick film of a material forming a part to be measured is deposited on a PET film manufactured by TOYOBO Co., Ltd. (product number: Cosmo Shine A4300, thickness: 100 μm). Then, by using a spectrophotometer (manufactured by Shimadzu Corporation, "UV-2450", compliant with JISK0115), transmittances of the part are measured with measurement wavelength range of from 900 nm to 2500 nm. An average value of the transmittances at the respective wavelengths is the heat ray transmittance.

Next, a material for use in the second portions 25 is explained. As shown in FIGS. 2 to 4, the second portion 25 may include a main portion 26, and a functional substance 28 dispersed in the main portion 26, the main portion 26 functioning as a binder.

As a material for use in the main portion 26, there may be used a resin material, in particular, a cured material of an ionizing radiation curing resin which cures by irradiation of an ionizing radiation, for example. As the ionizing radiation curing resin, an ultraviolet curing resin, an electron radiation curing resin, a visible light curing resin, a near-infrared radiation curing resin may be taken for instance. A refractive index of the main portion 26 may differ from a refractive index of the material forming the first portion 20. In this case, since an interface between the first portion 20 and the second portion 25 functions as a reflection surface that reflects light due to a refractive index difference, the light control member 10 can exert the daylighting function as described below.

As the functional substance 28, there may be used a colorant such as a pigment or a dye having a function of absorbing light of a predetermined wavelength range, such as visible light, a colorant such as a pigment or a dye having a function of absorbing light of a further predetermined wavelength range of the visible light, a substance having a function of absorbing heat rays, or a substance having a function of absorbing ultraviolet rays. In this specification, the "visible light" and the "heat ray" mean light of wavelength ranges generally defined as visible light and heat ray. Specifically, in this specification, the "visible light" is light having a wavelength range between 380 nm and 780 nm. In addition, in is specification, the "heat ray" is infrared light or infrared ray having a longer wavelength than that of the visible light. To be specific, the heat ray is light having a wavelength range between 900 nm and 2500 nm, which can give great impact on increase in temperature.

As the substance having a function of absorbing visible light, there may be used a black pigment such as a carbon black or titanium black. When the second portion 25 contains such a pigment as the functional substance 28, the light control member 10 can exert the light shielding function. When the second portion 25 contains, as the functional substance 28, a pigment having a further predetermined wavelength range of the visible light, the light control member 10 has a color because of such second portions 25, whereby a design of the light control member 10 itself can be improved.

As the functional substance 28 having a function of absorbing heat rays, there may be used particles having an absorbability for light in a near-infrared light wavelength range, and a transmissibility for light in a visible light wavelength range. For example, as the heat-ray absorptive functional substance 28, there may be used antimony tin oxide (ATO), indium tin oxide (ITO), lanthanum hexaboride ($LaB_6$), aluminum-doped zinc oxide, indium-doped zinc oxide, gallium-doped zinc oxide, tungsten oxide, cerium hexaboride, anhydrous antimony tin oxide, and copper sulfide, or mixture of these nanoparticles. When the second portion 25 contains the heat-ray absorptive functional substance 28, the light control member 10 can exert the heat shielding function.

As another example, the second portion 25 may contain, as the functional substance 28, a phosphorescent substance that emits phosphorescence. The phosphorescent substance is capable of absorbing and storing light energy such as sunlight or lamplight, and emitting light by discharging the light stored therein after irradiation of the light energy to the phosphorescent substance ends. Thus, thereafter, the second portion 25 containing the phosphorescent substance that has absorbed and stored the light can function as a light emitting member in the dark.

In the description above, although there is explained the example in which the second portion 25 contains the functional substance 28, the present invention is not limited to this example. The second portion 25 may not contain the functional substance 28. In addition, the first portion 20 in place of the second portion 25 may contain the functional substance 28. Further, in addition to the second portion 25, the first portion 20 may contain the functional substance 28 that is the same as the functional substance 28 contained in the second portion 25, or is different therefrom.

The sheet-like light control member 10 as structured above may be manufactured in the following manner. The body part 33 forming the first portions 20 and the base portion 30 is firstly manufactured by using a curing material such as epoxy acrylate, which will be cured by irradiation of an ionizing radiation such as an electron radiation or an ultraviolet radiation. To be specific, a mold roll having projections corresponding to the structure (position, shape or the like) of the grooves 33*a* of the body part 33, in other words, a mold roll having recesses corresponding to the structure (position, shape or the like) of the first portions 20, is prepared. A sheet for forming the substrate layer 35 is fed between the mold roll and a nip roll. In accordance with the feeding of the sheet, the curing material is supplied between the mold roll and the substrate layer 35. Thereafter, the curing material is pressed by the mold roll and the nip roll, such that the recesses of the mold roll are filled with the uncured, liquid curing material supplied on the substrate layer 35. At this time, the curing material is supplied to the substrate layer 35 such that the curing material is thicker than a depth of each recess of the mold roll, i.e., the mold roll and the substrate layer 35 are not brought into contact with each other, so that the above-described base portion (land part) 30 is formed integrally with the first portions 20 out of the curing material. After the space between the substrate layer 35 and the mold roll is filled with the uncured, liquid curing material, the curing material is irradiated with to cure (solidify) the curing material, whereby the body part 33 can be formed on the substrate layer 35.

Then, the second portions 25 are manufactured by using an uncured liquid composition which includes a curing material which cures to form the main portion 26, and the functional substance 28. As the curing material which cures to form the main portion 26, there may be used a curing material such as urethane acrylate which cures by an ionizing radiation. Firstly, the composition is supplied on the body part 33 that has been already formed. Thereafter, while the composition is filled into the grooves 33*a* formed between the adjacent first portions 20, i.e., into the portions corresponding to the projections of the mold roll, the superfluous composition overflowing from the grooves 33*a* is scraped by means of a doctor blade. After that, the composition between the first portions 20 is irradiated with an ionizing radiation to cure the composition, so that the second portions 25 are formed. Thus, there is manufactured the light control member 10 including the substrate layer 35, the base portion 30 disposed on the substrate layer 35, and the first portions 20 and the second portions 25 disposed on the base portion 30.

Next, the support device 40 is explained. As described above, the support device 40 supports the light control member 10 such that the orientation of the light control member 10 can be varied, in other words, the normal direction nd to the sheet plane of the light control member 10 can be varied. In the illustrated example, the support device 40 supports the light control member 10 such that the second direction d2, which is the longitudinal direction of the first portion 20 and the second portion 25, extends in the horizontal direction. The support device 40 supports the light control member 10 such that the light control member 10 can be rotated (rotatable) about an axis line in parallel with the second direction d2.

As a concrete structure, the support device 40 is composed of a support shaft member 44 connected to the light control member 10, and a driving apparatus 42 capable of driving the support shaft member 44. The support shaft member 44 extends in the second direction d2. The driving apparatus 42 is capable of rotating the support shaft member 44 about an axial direction of the support shaft member 44 in parallel with the second direction d2.

However, the present invention is not limited to the above-described example. As shown by the two-dot chain lines in FIG. 1, the support device 40 may be composed of the support shaft member 44 extending in the first direction d1, and the driving apparatus 42 capable of rotating and driving the support shaft member 44 about its axial direction. In this case, the support device 40 supports the light control member 10 so as to be capable of rotating the light control member 10 about an axis line in parallel with the first direction d1. Further, the light control member 10 may be supported by the support device 40 so as to be rotatable about an axis line in parallel with the first direction d1, and rotatable about an axis line in parallel with the second direction d2. In this case, the rotating motion of the light control member 10 about the axis line in parallel with the first direction d1, and the rotating motion of the light control member 10 about the axis line in parallel with the second direction d2, may be controlled independently of each other.

Next, operations of the aforementioned light control device 5 and the light control member 10 in this embodiment are described. Firstly, effects offered by the first portion 20 and the second portion 25 of the light control member 10 themselves are explained. Thereafter, there is explained an effect of the light control device 5, which is offered by the fact that the orientation of the light control member 10 can be adjusted.

In the state shown in FIG. 2, the light control member 10 is supported by the support device 40 such that the sheet plane of the light control member 10 extends vertically. Namely, the first direction d1 in the light control member 10 extends vertically, whereby the first portions 20 and the second portions 25 are alternately arranged vertically. As shown in FIG. 2, in the daytime with sunlight shower, sunlight beams L21 and L22, which come from a direction largely inclined upward relative to the normal direction to the sheet plane of the light control member 10, enter the first portion 20 of the light control member 10 and then move toward the second portion 25.

When the refractive index of the material forming the main portion 26 of the second portion 25 and the refractive index of the material forming the first portion 20 differ from each other, as shown in FIG. 2, a part of the sunlight beam L21, which entered the light control member 10 and moves toward the second portion 25, is reflected on the interface between the first portion 20 and the second portion 25. In particular, when the main portion 26 of the second portion 25 is formed of the material having a refractive index lower than that of the material forming the first portion 20, the sunlight beam L21, which entered the light control member 10 and moves toward the second portion 25, is totally reflected on the interface between the first portion 20 and the second portion 25, although it depends on an incident angle. Then, as shown in FIG. 2, the sunlight beam L21 reflected on the interface between the first portion 20 and the second portion 25 is thrown upward in the room. As a result, the sunlight beam L21, which was let into the room via the light control member 10, can be guided to the inside of the room distant from the position at which the window member 50 is installed. Namely, the light control member 10 can exert the excellent daylighting function. When the light control member 10 can sufficiently exert the daylighting function, the use of an indoor lighting apparatus can be restrained, energy can be saved and $CO_2$ can be reduced.

Next, a case in which the second portion 25 contains the functional substance 28 is explained. When the functional substance 28 has a function for absorbing visible light, as shown in FIG. 2, most of the sunlight beam L22 incident on the second portion 25 is absorbed by the second portion 25 because of the visible light absorbability of the functional substance 28. Thus, it can be effectively avoided that the visible light from the sun directly enters the room without changing its traveling direction. Namely, from the viewpoint of anti-glare effect, the light shielding function for restricting direct light into the room can be offered, whereby it can be prevented that a person in the room feels dazzled. Alternatively, when the functional substance 28 has a function for absorbing heat rays, as shown in FIG. 2, most of heat rays of the sunlight beam L22 incident on the second portion 25 is absorbed by the second portion 25 because of the heat ray absorbability of the functional substance 28. Thus, it can be effectively avoided that the heat rays from the sun enter the room, whereby the heat shielding function can be exerted.

As described above, the light control member 10 can exert the various useful functions on the sunlight incident on the light control member 10. In particular, when the light control member 10 can effectively exert the daylighting function, the light shielding function and the heat shielding function, which are taken by way of example, the use of an electric appliance such as an air conditioner, a lighting tool and so on can be restrained, whereby energy can be saved and $CO_2$ can be reduced.

The various functions exerted by the light control member 10 are effectively exerted only on light which is inclined upward by an angle within a predetermined range relative to the normal direction nd to the sheet plane of the light control member 10, depending on the structures of the first portion 20 and the second portion 25. On the other hand, an altitude of the sun continuously varies throughout the day. In addition, in different days, the altitude of the sun at the same clock time varies. To be specific, the sun reaches the maximum altitude at the noon during a day. In addition, the sun reaches the maximum altitude at the summer solstice during a year. Moreover, the altitude of the sun varies depending on a latitude of the place where the light control member 10 is installed.

As a result, there is a season or a period of time when the sunlight enters mainly from a traveling direction of a sunlight beam L23 shown by the two-dot chain lines in FIG. 2. The light control member 10 cannot exert the aforementioned daylighting function on the light beam L23. In addition, excluding light that is incident directly on the second portion 52 without passing through the first portion 20, the light control member 10 cannot exert the aforementioned light shielding function and the heat shielding function on the light beam L23.

On the other hand, in the light control device 5 described herein, the orientation (inclination) of the sheet-like light control member 10 can be varied. In particular, the support device 40 shown in FIG. 1 can rotate the light control member 10 about an axis line in parallel with the second direction d2. By adjusting the orientation of the light control member 10 as shown in FIG. 3, the aforementioned daylighting function, the heat shielding function and the light shielding function can be effectively exerted on the sunlight that comes from the same direction as that of the light beam L23 of FIG. 2 toward the light control member 10. In addition, when it is desired that the sunlight is let into the room as a whole, namely, when it is desired that the sunlight is let in as a whole without subjecting the sunlight to the function exerted by the light control member 10, by adjusting the orientation of the light control member 10 as shown in FIG. 4, the sunlight can transmit the light control member 10 without entering the second portion 25.

As described above, when the orientation of the light control member 10 can be adjusted depending on a position of the sun, it is advantageous to set large the aspect ratio (h/w) of the second portion 25 in a plane in parallel both with the normal direction nd to the sheet plane of the sheet-like light control member 10 shown in FIGS. 2 to 4, and with the first direction d1. When the aspect ratio (h/w) is set large, a desired optical function can be exerted significantly effectively on light coming from a direction inclined relative to the normal direction nd, while ensuring a large transmittance of light that moves in a direction near the normal direction nd. Namely, the expected function of the light control member 10 can be more effectively exerted, while greatly improving a transparency of the light control member 10 when observed along he normal direction nd.

When the orientation of the light control member 10 is unchanged, although the expected function can be exerted on light from the sun that is positioned at a predetermined altitude, an unintended function is disadvantageously exerted on light from the sun that is positioned at an altitude other than the predetermined altitude. When the aspect ratio of the second portion 25 is merely set large, this situation becomes serious and the disadvantage get worse. However, in this embodiment, since the orientation of the light control member 10 can be adjusted, the light control member 10 not only can avoid exerting an unintended function on light of the sun positioned at an altitude other than the predetermined altitude, but also can exert the expected function on the light by adjusting the orientation of the light control member 10.

As shown by the two-dot chain lines in FIG. 1, when the light control member 10 is supported by the support device 40 so as to be rotatable about an axis line in parallel with the first direction d1, the light control member 10 can receive sunlight squarely in the horizontal direction. In this case, a light receiving area of the light control member 10 can increase. In addition, for example, it is possible to restrain variation of incident angle of light that enters the interface between the first portion 20 and the second portion 25. Thus, also when the support device 40 supports the light control member 10 such that the light control member 10 can be rotated about an axis line in parallel with the first direction d1, the same effect provided when the light control member 10 is supported so as to be rotatable about an axis line in parallel with the second direction 2 can be more or less ensured.

In the above embodiment, the support device 40 supports the light control member 10 such that the orientation of the light control member 10 can be varied. Thus, by adjusting the orientation of the light control member 10 depending on installation places, seasons, hours and so on, the light control member 10 can exert the expected functions, such as the daylighting function, the light shielding function and the heat shielding function, on sunlight, regardless of seasons and hours. Namely, the sole light control member 10 can significantly effectively exert the expected functions, whereby it is not necessary to prepare plural light control members, and to select and install an optimum light control member from the prepared light control members, which is advantageous in terms of cost and convenience upon use. In addition, since the light control member 10 can exert the expected functions on sunlight, the use of an electric appliance such as an air conditioner, a lighting tool and so on can be restrained, whereby energy can be saved and $CO_2$ can be reduced.

The aforementioned embodiment can be variously modified. For example, in the above-described embodiment, although there is explained the example in which the second direction d2 of the light control member 10 is in parallel with the horizontal direction, the present invention is not limited thereto. For example, the second direction d2 of the light control member 10 may not be in parallel with the horizontal direction, or may be perpendicular to the horizontal direction.

Moreover, the light control member 10 may further have a functional layer expected to offer various functions, in addition to the first portions 20 and the second portions 25. For example, the light control member 10 may be further provided with a hard coat layer having abrasion resistance, as a layer closest to the inside of the room.

Next, a second embodiment different from the aforementioned embodiment is explained with reference mainly to FIGS. 5 to 9. In the below description and the drawings used in the below description, a part that can be structured similarly to the above embodiment is shown by the same reference number, and overlapping explanation is omitted.

Figure 5:
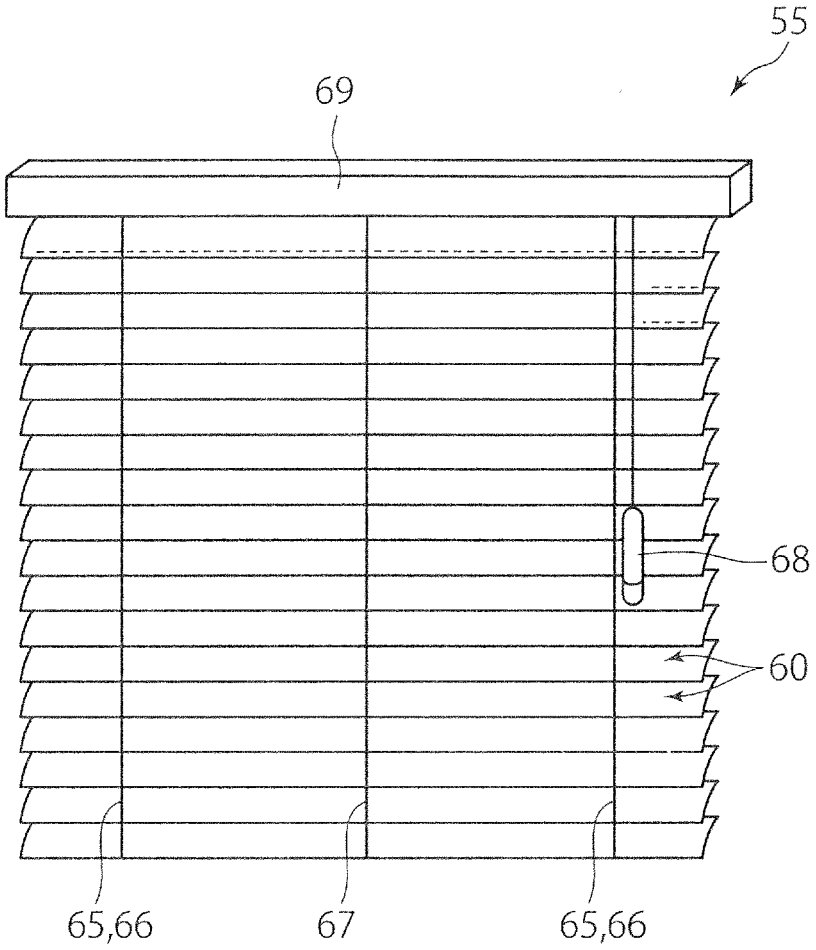
FIG. 5 is a perspective view schematically showing a light control device including light control members and a support device, for explaining another embodiment of the present invention wherein the light control device is structured as a so-called shade (blind).
Figure 7:
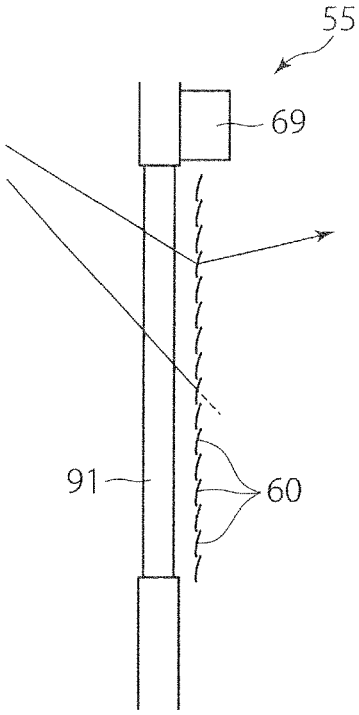
FIG. 7 is a side view of the light control device of FIG. 5.
Figure 8:
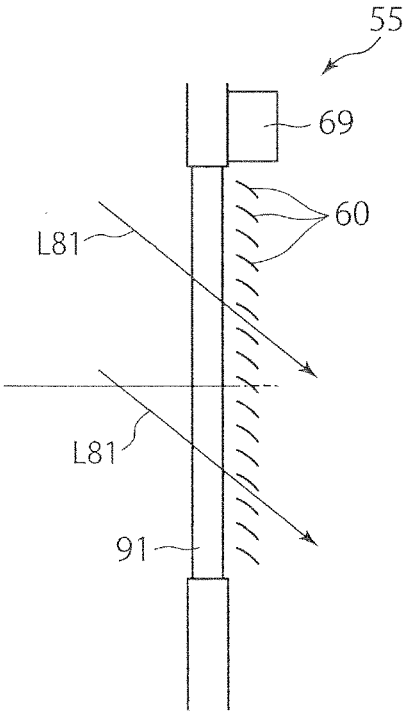
FIG. 8 is a side view showing the light control device in which the light control member is supported in an orientation different from that of FIG. 7.
Figure 9:
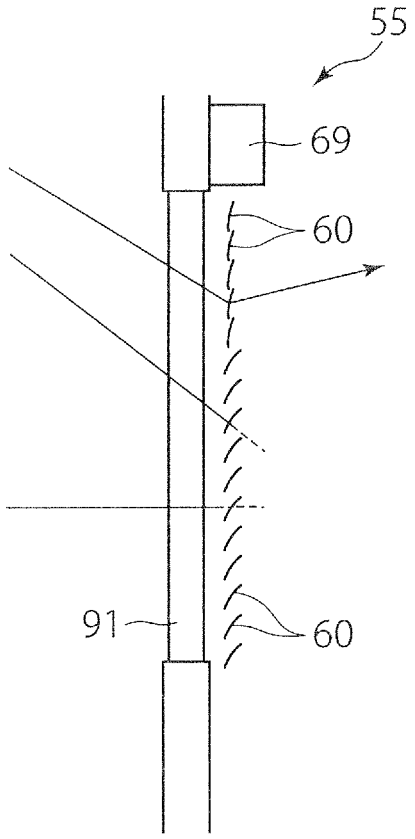
FIG. 9 is a side view showing a modification example of the light control device of FIG. 5.

As shown in FIG. 5, a light control device 55 has light control members 60 arranged in one direction, and a support device 65 that supports the light control members 60 such that an orientation of each light control member 60 can be varied. In the second embodiment, the light control device 55 is formed as a so-called shade (blind). As shown in FIGS. 7 to 9, the light control device 55 is located on a position facing a daylighting window 91. The light control member 60 is referred to as slat or louver board, and is formed as a thin plate-like member which is elongated in a direction not in parallel with the up and down direction. Each light control member 60 is supported by the support device 65 such that its orientation (inclination) can be varied. By adjusting the orientation of the light control member 60, the light control device 55, which is located on a position facing the daylighting window 91, can offer the same effects as those of the aforementioned embodiment. In particular, according to the light control device 55 in the form of a shade, a large variation amount of the orientation of the light control member 60, in other words, a large angular range, in which the normal direction to a plate plane of the thin plate-like light control member 60 can be moved, can be obtained. Thus, the above-described effects can be more effectively exerted. The light control device 55 shown in FIGS. 5 to 9 is described in more detail.

In the second embodiment, the light control members 60 included in the light control device 55 are arranged vertically, and each light control member 60 extends horizontally. The light control device 55 has: an attachment box 69 serving as an attachment tool to a wall; a ladder cord 66 extending downward from the attachment box 69, the ladder cord 66 supporting the light control members 60 at vertical intervals; an elevation cord 67 for drawing upward the light control members 60; and an operation grip 68 connected to the ladder cord 66 and the elevation cord 67.

The ladder cord 66 serves as the support device 65 in the second embodiment. In this embodiment, the ladder cord 66 controls the orientation of each light control member 60 such that all the light control members 60 included in the light control device 55 are substantially parallel. By operating the ladder cord 66 through the operation grip 68, the orientation of the light control member 60 can be adjusted. At this time, each elongated light control member 60 is rotated about an axis line in parallel with its longitudinal direction so that the orientation of the elongated light control member 60 is varied.

On the other hand, by operating the elevation cord 67 through the operation grip 68, the light control members 60 can be drawn upward in such a manner that the vertical intervals between the light control members 60 are sequentially narrowed below. At this time, the light control members 60 are at least partially accommodated in the attachment box 69, so that the daylighting window 91 is exposed to the room. Similarly, by operating the elevation cord 67 through the operation grip 68, the light control members 60 gathered in the upper position can be drawn downward to the position facing the daylighting window 91.

In the light control device 55 in the second embodiment, various known structures that are applied to commercially available prevalent shades can be used as the attachment box 69, the operation grip 68, the ladder cord 66, the elevation cord 67, and the mechanism for operating the ladder cord 66 and the elevation cord 67 through the operation grip 68.

Figure 6:
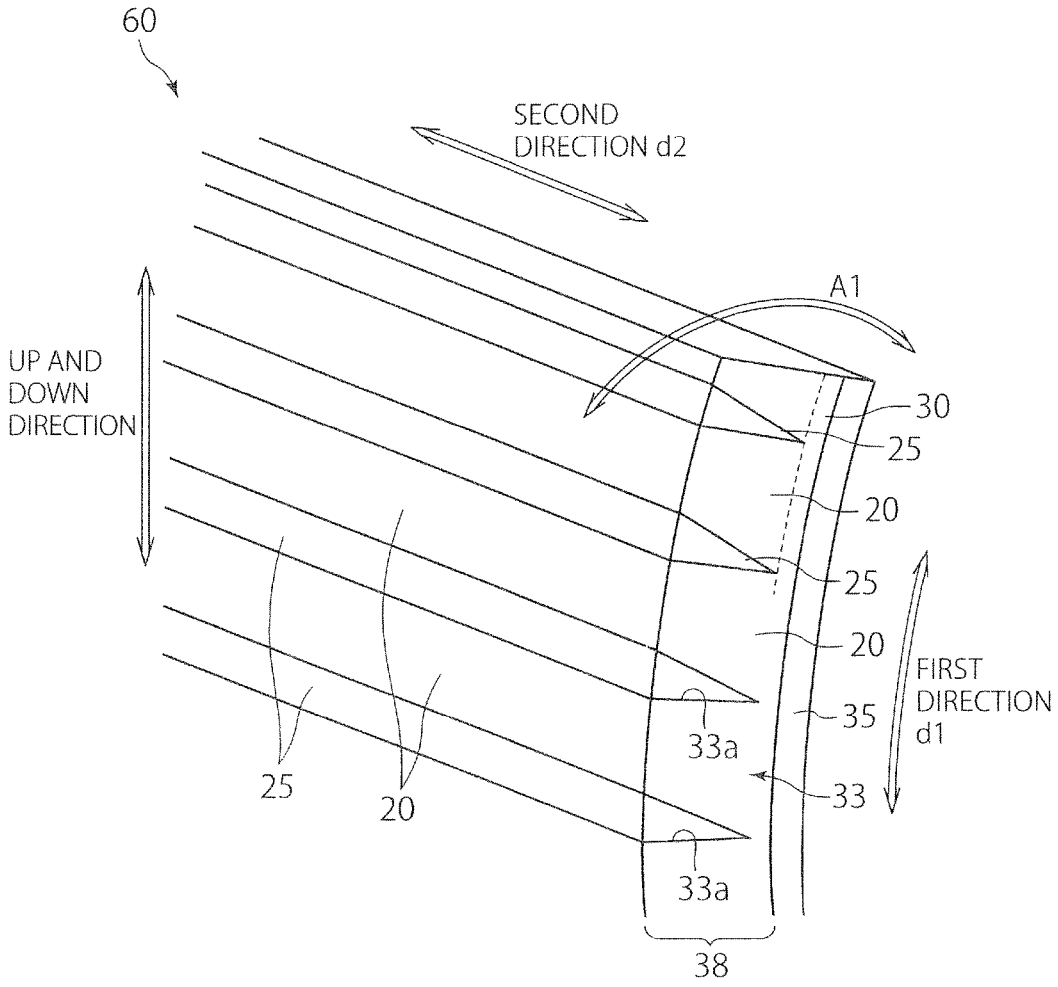
FIG. 6 is a partial perspective view showing the light control member constituting a slat of the light control device of FIG. 5.

As shown in FIG. 6, the light control member 60 in the second embodiment is formed as a thin plate that is slightly curved. In addition, in the second embodiment, each light control member 60 has an elongate shape. The light control member 60 in the second embodiment differs from the light control member 10 in the aforementioned embodiment in that the light control member 60 is curved and has an elongated contour. In the other points, the light control member 60 can be structured similarly to the light control member 10 in the aforementioned embodiment. However, in the second embodiment, it is not necessary that the light control member is curved, and the light control member 60 may have a flat plate-like shape.

Thus, the light control member 60 in the second embodiment includes the first portions 20 and the second portions 25, similarly to the light control member 10 in the aforementioned embodiment. As shown in FIG. 6, the first portions 20 may be arranged in the first direction d1 along a sheet plane of the light control member 60, and each first portion 20 may extend in the second direction d2 that is not in parallel with the first direction d1 and along the sheet plane of the light control member 60. The second portions 25 may be arranged in the first direction d1 alternately with the first portions 20, and each second portion 25 may extend in the second direction. The first direction d1 is a direction that extends curvilinearly along the curved sheet plane of the light control member 60. In the example shown in FIG. 6, the first portions 20 and the second portions 25 are alternately arranged along the curved direction d1. In addition, the light control member 60 shown in FIG. 6 has a substrate layer 35 and a light control layer 38 supported on the substrate layer 35. The light control layer 38 includes the body part 33 having grooves 33*a* formed therein, and the second portions 25 respectively formed in the grooves 33*a* of the body part 33. The body part 33 includes the base portion 30 and the first portion 20 supported on the base portion 30.

As shown by the arrow A1 in FIG. 6, the ladder cord 66 serving as the support device 65 supports each light control member 60 elongating in the second direction d2, such that the light control member 60 can be rotated about an axis line in parallel with the second direction d2. Namely, in the light control device 55 in the second embodiment, divided pieces, which are formed by dividing the light control member 10 in the first embodiment along the first direction d1, are arranged in one direction (in the illustrated example, up and down direction), and each divided piece of the light control member 10 is supported by the ladder cord 66 so as to be rotatable about an axis line in parallel with the second direction d2.

Thus, as shown in FIG. 7, when the sheet plane of each light control member 60 extends substantially vertically, the light control device 55 can exert various functions expected to be offered by the light control member 60, such as the daylighting function, the light shielding function, the heat shielding function and so on, on sunlight coming from a predetermined direction. In addition, when the altitude of the sun varies, the orientation of all the light control members 60 included in the light control device 55 is adjusted by using the ladder cord 66 as the support device (support means) 65, so that the light control device 55 can effectively exert the expected functions on light from the sun whose altitude has varied. Namely, according also to the second embodiment, similarly to the aforementioned embodiment, by adjusting the orientation (inclination) of the light control member 60 depending on installation places, seasons, hours and so on, the light control members 60 included in the light control device 55 can exert the expected functions such as the daylighting function, the light shielding function, the heat shielding function and so on, on sunlight, regardless of seasons and hours.

In addition, in the second embodiment, the light control member 60 is elongated in the second direction d2, and is small in size in the first direction d1. Thus, even when the light control member 60 is rotated about an axis line in parallel with the second direction d2, the size of the light control device 55 in a direction perpendicular both to the arrangement direction of the light control members 60 and to the second direction d2, i.e., the size of the light control device 55 in the normal direction of the daylighting window 91 in FIGS. 7 and 8 can be maintained small. In accordance therewith, the orientation of the light control member 60 can be freely adjusted by using the support device 65 within a wide angular range without any restriction. Thus, according to the second embodiment, the light control members 60 included in the light control device 55 can more effectively exert the expected functions, such as the daylighting function, the light shielding function, the heat shielding function, etc., on sunlight, regardless of seasons and hours.

In the state shown in FIG. 7, i.e., all the light control members 60 as slats are closed, the two light control members 60 adjacent in the arrangement direction are partially overlapped with each other in the arrangement direction. Thus, it can be prevented that sunlight advances between the two adjacent light control members 60 without being subjected to a predetermined function of the two light control members 60.

On the other hand, when it is desired that sunlight is let into the room as a whole, i.e., when it is desired that the sunlight is let in as a whole without being subjected to a predetermined function of the light control members 60, as shown in FIG. 8, the orientations of the light control members 60 are adjusted such that a sunlight beam 81 can pass through the two light control members 60 adjacent to each other in the arrangement direction. According to such a method, it is possible to let the sunlight into the room at a higher transmittance, as compared with a case in which the sunlight transmits through the first portion 20 of the light control member 60. In addition, when the second portion 25 contains the functional substance 28 having a visible light shielding ability, in the state shown in FIG. 8, the room cannot be seen in the normal direction of the daylighting window 91, while the sunlight can be let in.

The above-described second embodiment can be variously modified. For example, in the second embodiment, although there is described the example in which the second direction d2 of the light control member 60 is in parallel with the horizontal direction, the present invention is not limited thereto. For example, the second direction d2 of the light control member 60 may not be in parallel with the horizontal direction, or may be perpendicular to the horizontal direction.

Moreover, the light control member 60 may further have a functional layer expected to offer various functions, in addition to the first portions 20 and the second portions 25. For example, the light control member 60 may be further provided with a hard coat layer having abrasion resistance, as a layer closest to the inside of the room.

Furthermore, the orientations of all the light control members 60 included in the light control device 55 are operated all together by the ladder cord 66 such that the light control members 60 are in parallel with one another. However, for example, by operating the orientations of some light control members 60 included in the light control device 55 and the orientations of light control members 60 other than the some light control members 60 may be independently adjusted by means of separate ladder cords.

The invention claimed is:

1. A light control device comprising:

a plurality of sheet-like light control members; and a support device supporting the light control members such that an orientation of the light control members is variable, wherein each light control member includes first portions arranged in a first direction along a sheet plane of the light control member, each first portion extending in a second direction that is in non-parallel with respect to the first direction and along the sheet plane of the light control member, second portions arranged in the first direction alternately with respect to the first portions, each second portion extending in the second direction, wherein each second portion includes a resin material and functional substances dispersed in the resin material, and a sheet-like base portion supporting the first portions and the second portions, wherein the base portion is integrally formed with the first portions;

wherein each light control member has a curved shape, and the first direction extends along a curved plate surface of the light control member, and wherein a width along the first direction of the second portions decreases away from a convex surface side of the curved light control member to a concave surface side of the curved light control member.

2. The light control device according to claim 1, wherein the support device supports the light control members such that the light control members are rotatable about an axis line in parallel with the second direction.

3. The light control device according to claim 1, wherein the support device supports the light control members such that the light control members are rotatable about an axis line in parallel with the first direction.

4. The light control device according to claim 3, wherein the support device is configured to support the light control members such that the light control members are rotatable about an axis line in parallel with the second direction.

5. The light control device according to claim 4, wherein the support device is configured to support the light control members such that the rotating motion of the light control members about the axis line in parallel with the first direction is independent from the rotating motion of the light members about the axis line in parallel with the second direction.

6. The light control device according to claim 1, wherein the light control members are arranged in one direction and supported by the support device, and each light control member is elongated in a longitudinal direction perpendicular to the one direction.

7. The light control device according to claim 6, wherein the support device is configured to support the light control members such that each light control member is rotatable about an axis line in parallel with the longitudinal direction of the light control member.

8. The light control device according to claim 6, wherein the longitudinal direction of the light control members and the second direction are in parallel with each other.

9. The light control device according to claim 1, wherein an arrangement pitch of the second portions along the second direction is 1 mm or less.

10. The light control device according to claim 1, wherein an aspect ratio of the second portion is greater than 1 and less than 10.

11. The light control device according to claim 1, wherein a visible light transmittance of the first portions is greater than 50%.

12. The light control device according to claim 1, wherein a refractive index of the first portions is greater than that of the second portions.

13. The light control device according to claim 1, wherein the second portions further include a colorant configured to absorb visible light.

14. The light control device according to claim 1, wherein an orientation of a first plurality of the light control members is adjusted by the support device, and an orientation of a second plurality of the light control members, other than the first plurality of light control members, is adjusted by the support device independently with respect to the first plurality of light control members, and wherein the first plurality of the light control members is located above the second plurality of the light control members in an up and down direction.

* * * * *